US005517881A

United States Patent [19]

Burns

[11] Patent Number: 5,517,881

[45] Date of Patent: May 21, 1996

[54] DEVICE FOR OPENING OR CLOSING TWIST CLOSURE

[75] Inventor: William C. Burns, Bedford, N.H.

[73] Assignee: Dr. Schleuniger Pharmatron AG, Solathurn, Switzerland

[21] Appl. No.: 241,097

[22] Filed: May 11, 1994

[30] Foreign Application Priority Data

Aug. 10, 1993 [CH] Switzerland ..... 2372/93

[51] Int. Cl.[6] ..... B67B 7/14

[52] U.S. Cl. ..... 81/3.4; 53/317; 53/331.5; 53/381.4

[58] Field of Search ..... 81/3.09, 3.4, 3.43; 53/317, 318, 331.5, 381.4

[56] References Cited

U.S. PATENT DOCUMENTS

| | | | |
|---|---|---|---|
| 476,712 | 6/1892 | Wickham . | |
| 1,954,422 | 4/1934 | McIntyre . | |
| 2,026,118 | 12/1935 | Barnby . | |
| 2,985,045 | 5/1961 | Grasty et al. . | |
| 3,134,211 | 5/1964 | Roberts et al. | 53/331.5 |
| 3,191,354 | 6/1965 | McElroy et al. | 53/331.5 X |
| 3,583,263 | 6/1971 | Herigstad . | |
| 4,187,662 | 2/1980 | Cochran | 53/381.4 |
| 4,702,129 | 10/1987 | Allen . | |
| 4,760,763 | 8/1988 | Trick et al. . | |
| 4,766,781 | 8/1988 | Grisë et al. . | |
| 5,148,652 | 9/1992 | Herzog | 53/331.5 |
| 5,167,172 | 12/1992 | Heebner . | |

FOREIGN PATENT DOCUMENTS

| | | |
|---|---|---|
| 1493262 | 9/1966 | France . |
| 2598698 | 5/1986 | France . |

*Primary Examiner*—James G. Smith

[57] ABSTRACT

A flat elastic membrane is fixed to an inelastic edge surrounding a cavity on a coupling element. The elastic membrane can be pressed onto twist closures of different types and sizes to permit transmission of torsional force from the coupling element to the twist closures.

29 Claims, 5 Drawing Sheets

DEVICE FOR OPENING OR CLOSING TWIST CLOSURE

BACKGROUND OF THE INVENTION

1. Field of the Invention

This invention relates to a device for opening or closing twist closures.

2. Relevant Prior Art

Such devices are frequently used: in the household for opening bottles, preserve jars, etc.; in the beverage industry for closing bottles or the like; in measurement for coupling torque gauges to bottles, tablet containers, etc. for determining the required opening torque thereof.

The known devices have different embodiments. In the household, pliers-like devices are generally used, with the aid of which the closure is gripped and opening is facilitated because of the increased torque. These devices are suitable for twist closures of different diameters. However, it is scarcely possible to apply a vertical force to the closure for opening certain (in particular, childproof) closures, which are prescribed especially for containers for pharmaceutical products. This proves to be a disadvantage. Furthermore, relatively great force must be applied for closing the arms of the pliers in order to avoid slipping when the device is operated.

Manipulators having complicated gripping mechanisms are known from the beverage industry. For example, a device for an electronic cover torque gauge has been successfully marketed for years and is known in the measurement sector. This device has a relatively complicated toggle lever mechanism, with the aid of which the internal diameter of an elastic ring can be varied (reduced) by applying an axial compressive force, so that the twist closure can be gripped laterally and actuated.

All these devices are of relatively complicated design, in particular to enable closures of different diameters (especially in their tolerance range) to be gripped and actuated. In known devices, for example, the zones provided for gripping the closure are designed with protuberances. However, this resulted in slipping of the device on the closure in the case of negative tolerances.

SUMMARY OF THE INVENTION

It is the object of the invention to avoid the disadvantages of the known devices, and to provide a simple device that enables a closure to be opened or closed safely and without effort. A further object is that the new device should not give rise to any danger of injury and, in particular, should be suitable for use by handicapped people. Further objects of the invention are intended to lead to reliable manufacture and use.

The object is achieved according to the present invention by: a grippable coupling element having a cavity and a substantially inelastic edge surrounding the cavity. A flat elastic membrane is fastened to the inelastic edge over the cavity. The elastic membrane can be pressed against the twist closure to be opened or closed, and transmits to the twist closure a torsional force that an operator has applied to the coupling element.

Further developments of the invention relate to advantageous embodiments that can be simply produced and/or perform a plurality of functions.

DETAILED DESCRIPTION OF THE DRAWINGS

Preferred embodiments of the invention will now be described taken together with the drawings, in which.

DETAILED DESCRIPTION OF PREFERRED EMBODIMENTS

Figure 1:
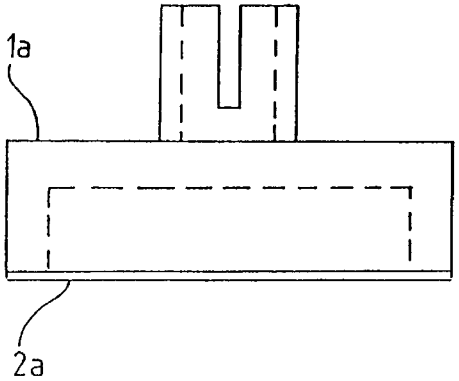
FIG. 1 shows a view of a device according to the invention for industrial use or use for measurement.
Figure 2:
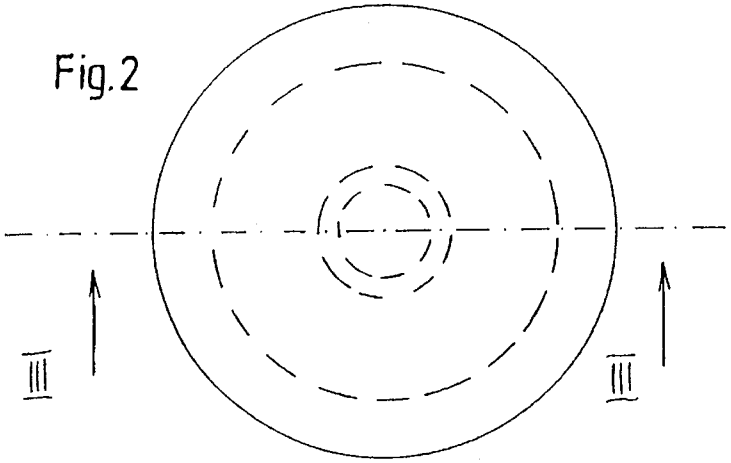
FIG. 2 shows a plan view of the means of FIG. 1.
Figure 3:
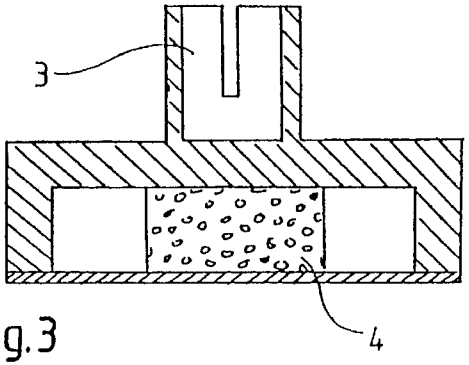
FIG. 3 shows a section along III—III of FIG. 2.

Referring to FIGS. 1–10, the reference numerals have the following meanings:

• 1*a*, 1*b* Coupling element: may be plastic or metal, may be pot-like, with or without openings or recesses; can also be merely in the form of a stable, inelastic ring. The essential component is a substantially inelastic edge enclosing a surface provided by an elastic material that is fastened to the edge and may be a membrane of elastic material. The coupling element may take the form of the following parts:

• 1*a* Fastening part: an elastic material is fastened to it;

• 1*b* Grip part: The coupling element acts as a hand grip for an operator;

• 2 Elastic material or membrane: This is a disk or component of elastic material, for example rubber or foam (in particular integral foam) and can be fastened to the edge of the coupling element. Advantageously, the elastic material is cut from sheets of natural gum rubber. Talc or other release agents used when storing the sheets is scrubbed from the elastic material. Also, it is advantageous to keep the surface of the elastic membrane clean. Soap and water, or glass window cleaner is adequate for this purpose. Advantageously, the surface of the membrane that contacts the top of the twist closure is smooth. Alternatively, the surface may be textured. Whether the surface is smooth or textured depends upon a number of parameters. These include the material of the twist closure, temperature, rubber quality, rubber age, membrane thickness, and the pressure that is applied to the hollow coupling element.

• 3 Adapter: This includes conventional means, such as mechanical couplings, etc. that permit connection of the coupling element to a machine (manipulator, torque gauge, etc.).

• 4 Spring element: This includes any elastic element that counteracts the pressure against the membrane (from outside, toward the coupling element). In particular, it is a foam that is supported partly or over its entire area between the membrane and the coupling element. In a special case, the membrane and the spring element may also be in the form of a single piece, for example, as integral foam.

• 5 Twist closure: This includes, for example, a screw or bayonet cap that can be connected to a bottle or the like, or can be removed therefrom by turning. In particular, this includes child-proof twist closures where it is also necessary to apply an axial force for opening.

• 6 Bottle: This includes any container that can be closed, or is closed, by a twist closure.

• 7 Gripping points: These include roughened, raised or depressed portions on the surface of the grip part, for improved handling thereof.

• 8 Tube: This denotes a component, for example a tube connection, by which air can be pumped into or sucked out of the cavity enclosed by the coupling element.

• 9 Cavity: The space enclosed by the coupling element.

• 10 Openings: These include openings in the membrane, in the form of at least one porous region of the membrane, or, for example, holes through a foam disk.

• 11 Holding Part: This holds the elastic membrane to the coupling element and to the inelastic edge of the coupling element.

Referring to FIGS. 1–4, the functional principle of the invention is based on friction between an elastic material (membrane) 2 and a twist closure 5. If the coupling element (fastening part) 1*a* and the membrane 2 are pressed with a certain force onto the twist closure 5, assuming an appropriate choice of the elastic material, the twist closure 5 is carried with the membrane 2 and opens or closes. There is also the advantage that the coupling element la need not be mounted exactly at right angles to the twist closure 5, which may be helpful in particular for physically handicapped people. Relatively small angle deviations are automatically compensated.

The foam 4 that may support the membrane 2 permits the application of greater pressures without damaging the membrane 2.

Figure 6:
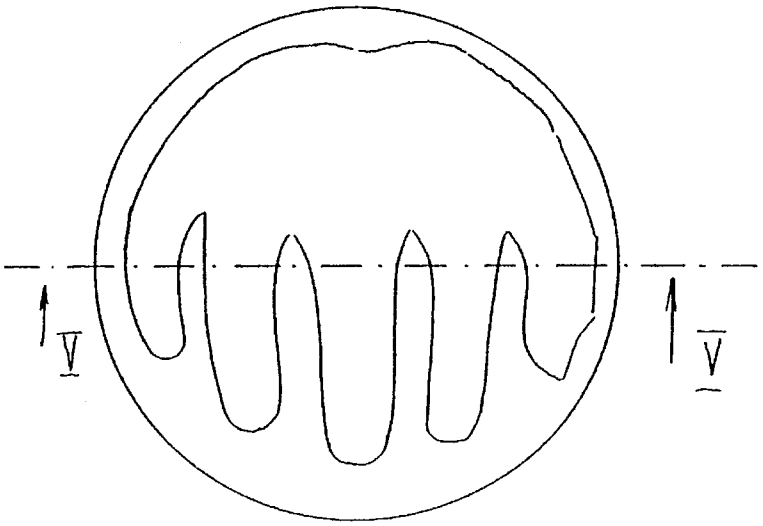
FIG. 6 shows a plan view of the device of FIG. 5.
Figure 5:
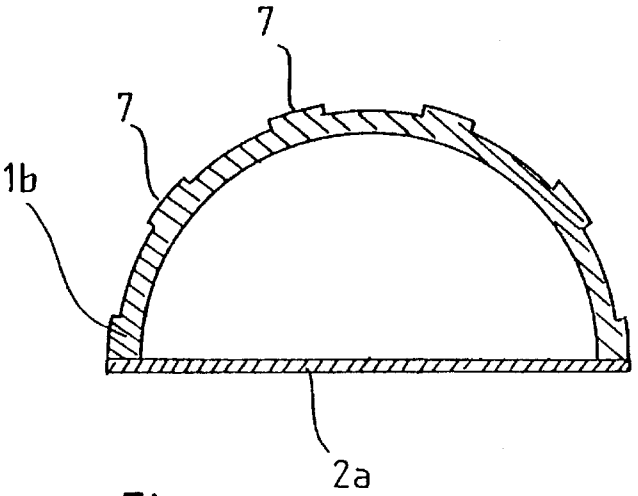
FIG. 5 shows a section along V—V of FIG. 6 of a variant of a device according to the invention, in particular for use in the household.

FIGS. 5 and 6 show a particularly simple and economical embodiment that is in the form of a semicircular coupling element (grip part) 1*b* having gripping points 7 and produced, for example, by injection molding. Such an embodiment is suitable in particular for use in the household. This facilitates the opening or reclosing of closures even for elderly or fragile people, since they need only place the palm of the hand on the grip part 1*b* and need not use their fingers in order to apply sufficient pressure and/or torsional force to the closure. If necessary, both hands may also be placed on a grip part 1*b*. To improve the handling of such a device, the coupling element could also be an elongated oval shape, for example, corresponding to the shape of a longitudinally divided hen's egg, with the result that it is possible both to apply a greater torque and the possibility of slipping of the hand during the rotary movement is further reduced.

Figure 7:
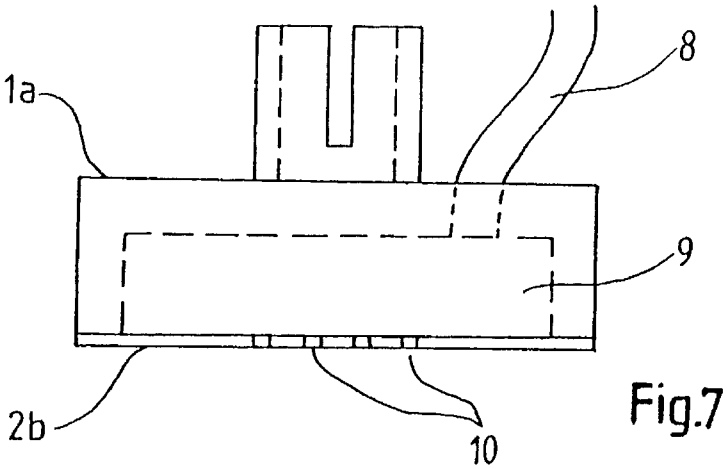
FIG. 7 shows a variant of FIG. 1 having a suction air connection for industrial use.

FIG. 7 shows a further variant of the device according to the invention, which can be used not only for turning closures but also for transporting them, for example from a manipulator to a bottle. Here, the membrane 2*b* is in a central region that in any case should be smaller than the smallest diameter of a twist closure intended to be transported, and should be porous or should be provided with openings 10. Reduced pressure can be generated in the cavity 9 via a tube leading to a vacuum connection. This makes it possible to suck a closure cap to the membrane 2*b* and to transport said cap.

The membranes may have different surface characteristics, i.e., may have, for example, particularly good grip. To permit changing the membrane (wearing part), it is possible to provide, on the coupling element (or grip part), devices that are comparable to fasteners for stretched material on drums. Preferred embodiments thereof are evident from FIG. 8–10.

Figure 8:
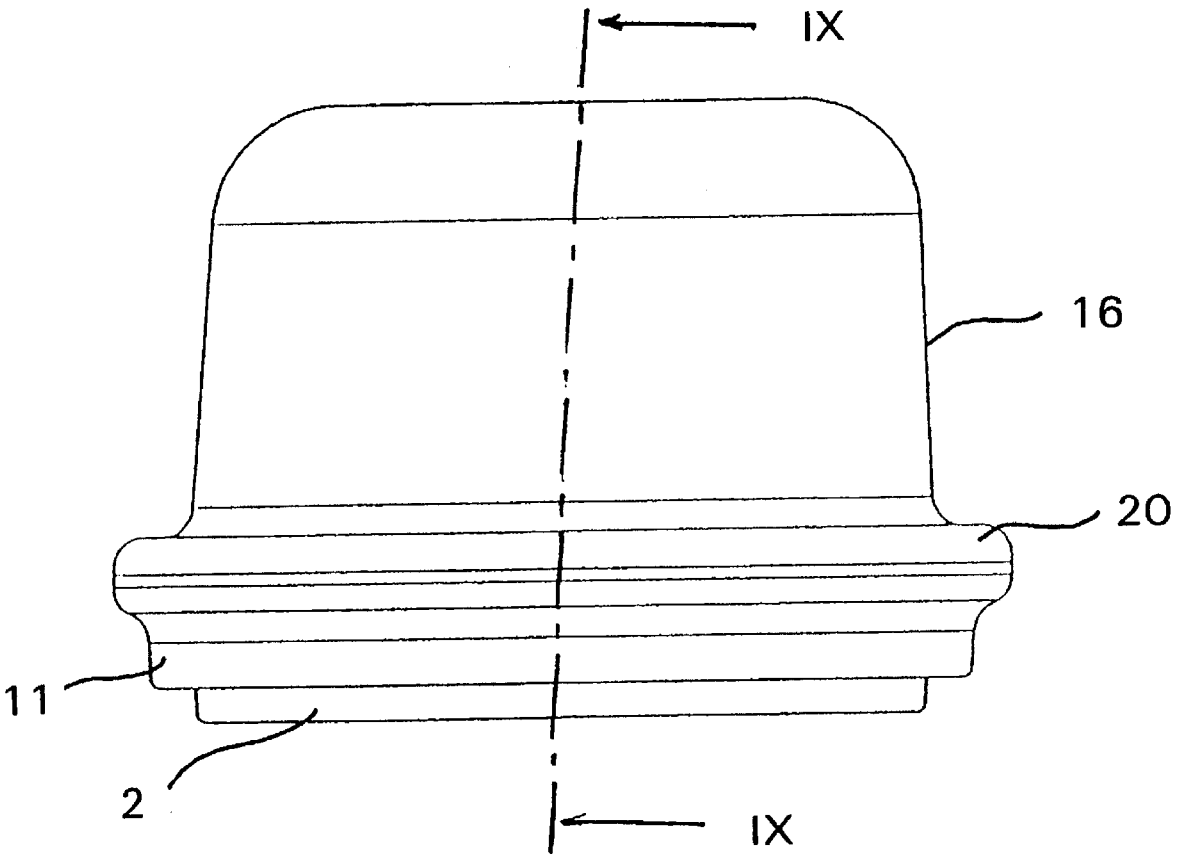
FIG. 8 shows a further embodiment of the invention.
Figure 9:
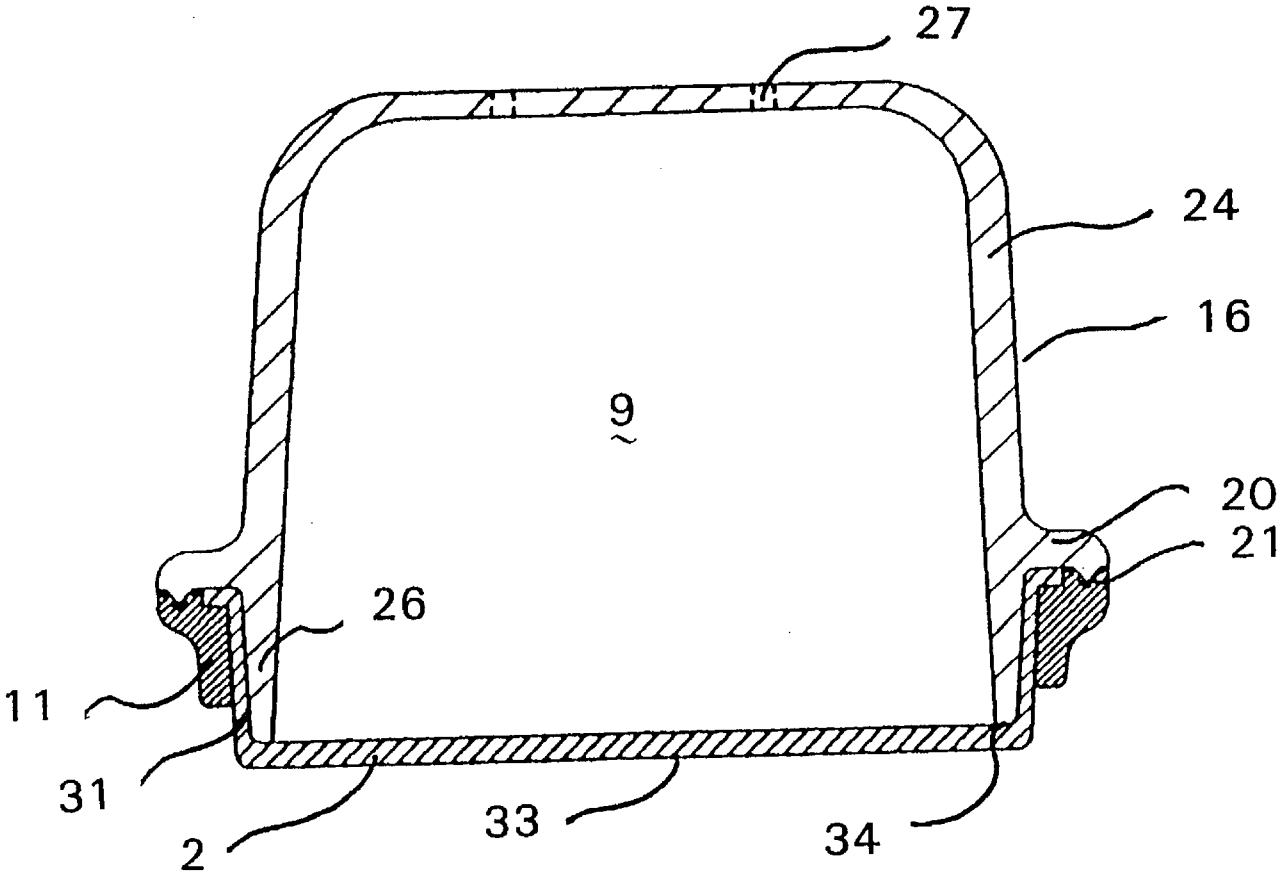
FIG. 9 shows a section along IX—IX in FIG. 8.
Figure 10:
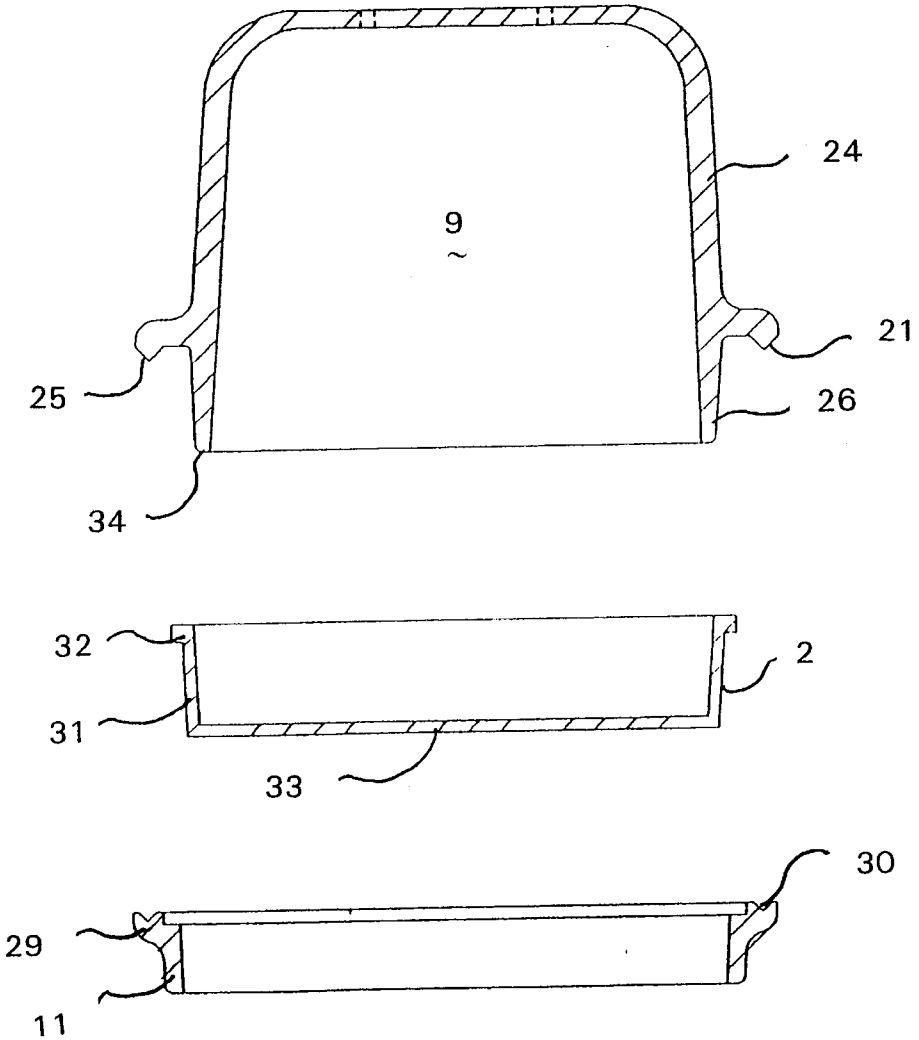
FIG. 10 shows an exploded view of the section according to FIG. 9, showing separately the rubber membrane that is held in place in the embodiment shown in FIG. 8.

FIGS. 8–10 show another preferred embodiment of a device according to the present invention. In this embodiment, a coupling element (grip part) 1*b* acts as a hand grip for an operator and has a wall 24 enclosing a hollow cavity 9. An annular flange 20 extends from the wall 24 and has a downward extending V-edge 21 formed by side walls 25 at 90° to each Other. A lower annular wall portion 26 of wall 24 extends below the flange 20, and has a lower inelastic edge 34. The inner and outer surfaces of wall portion 26 are tapered at an angle of 3°.

The outer surface of wall 24 is textured so that it may be gripped and held securely by the fingers. The grip part 1*b* has 8 holes 27 arranged equally spaced on a common radius. These holes allow air to pass out of the cavity 9 when the device is in use.

A ring or holding part 11 has an annular flange 29 with an upward 90° V-groove 30 that mates with downward V-edge 21. The flanges 20 and 29 are bonded together by ultrasound in the area of V-edge 21 and V-groove 30.

A rubber membrane 2 has side walls 31 with an annular flange 32 at the top. The walls 31 and flange 32 fit and are held in the space between the holding ring 11 and the lower annular wall portion 26. The rubber membrane 2 has a lower surface 33 that is flat and smooth.

Figure 4:
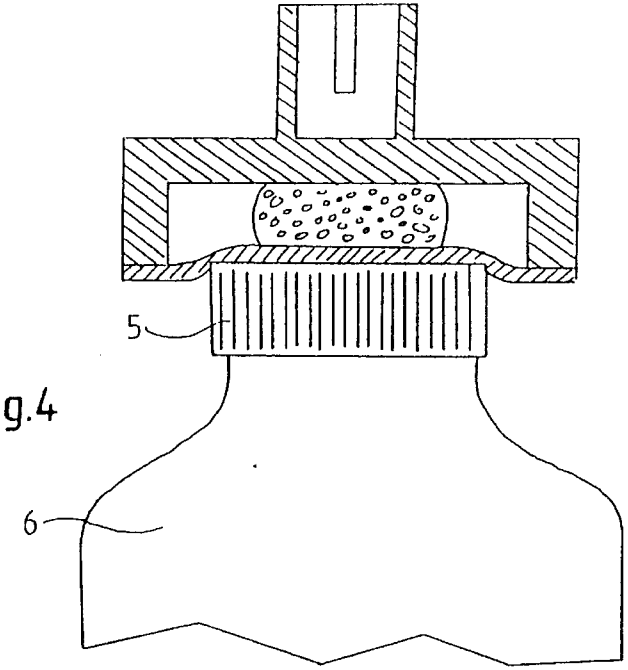
FIG. 4 shows a section corresponding to FIG. 3, in the engagement position on a bottle.

In use, the rubber membrane 2 is placed down upon and in contact with the top of a twist closure 5, such as shown in FIG. 4. The coefficient of adhesion of the rubber membrane over the contact surface area of twist closure 5, when turning the grip part 1*b* causes the twist closure 5 to turn with the grip part 1*b*. The greater the contact surface area of the membrane on the twist closure, the greater the ability to twist the closure. Pushing down on the grip part 1*b* causes the rubber membrane to distort and bend about the upper edge of the twist closure, as shown in FIG. 4. As a result, the rubber membrane contacts and adheres to the upper outer surface of the twist closure 5 further aiding its rotation. Air within the cavity 9 escapes through the holes 27 when the membrane 2 distorts inwardly into the cavity 9.

Equivalent modifications of the various parts described above are not shown, but are within the scope of the invention. Thus, arrangements in which two membranes of different elasticity are provided, for example, on opposite sides of a coupling element in order to permit a choice for different closure sizes or closure types are also within the scope of the invention.

I claim:

1. A device for opening or closing twist closures comprising a grippable coupling element having a substantially inelastic edge surrounding an opening, and a flat elastic membrane fastened to said inelastic edge over said opening, said elastic membrane comprising a thin, soft material having a smooth grip surface arranged to contact said twist closures, which grip surface is flat in a state disengaged from said twist closures.

2. A device according to claim 1, wherein said coupling element comprises a flange extending outwardly beyond said inelastic edge and including an opening, and said elastic membrane comprises a wall portion secured within said opening outwardly of said inelastic edge.

3. A device according to claim 2, wherein said coupling element has at least one opening into said cavity.

4. A device according to claim 1, wherein said smooth surface is devoid of talc and releasing agents.

5. A device according to claim 1, wherein said coupling element has an adapter for connection to another apparatus.

6. A device according to claim 1, wherein said coupling element has gripping portions for manual gripping.

7. A device according to claim 1, wherein said coupling element has an inner surface defining a cavity, further comprising a spring element mounted in said cavity between said elastic member and said inner surface.

8. A device according to claim 7, wherein said spring element comprises a foam.

9. A device according to claim 7, wherein said spring element is integral with said membrane.

10. A device according to claim 9, wherein said spring element and said elastic membrane are formed as an integral foam.

11. A device according to claim 1, wherein said elastic membrane has at least a region that is porous.

12. A device according to claim 1, wherein said elastic membrane has at least a region that is provided with openings.

13. A device according to claim 1, wherein said coupling element comprises a hollow body having a wall defining a cavity, wherein said inelastic edge is positioned on said wall.

14. A device according to claim 13, wherein said cavity is connected to a vacuum device.

15. A device according to claim 13, wherein said elastic membrane is greater in length along at least one straight line than a corresponding straight line connecting points on said inelastic edge.

16. A device according to claim 1, wherein said coupling element comprises a plurality of parts rigidly connected to one another.

17. A device according to claim 16, wherein said plurality of parts comprises a grip part and a holding part for holding said elastic membrane to said grip part.

18. A device according to claim 17, wherein a cavity is formed in said grip part with a wall that extends beyond said holding part and said inelastic edge comprises an edge on said wall having a smaller circumference than said holding part.

19. A device according to claim 17, wherein said elastic membrane is arranged to be secured between said holding part and said grip part.

20. A device according to claim 1, wherein said smooth membrane material is substantially natural gum rubber.

21. A device according to claim 1, wherein each of said twist closures has a peripheral edge and said opening in said inelastic edge and said membrane extend beyond said peripheral edge.

22. A device according to claim 21, wherein said membrane is arranged to bend flexibly over said peripheral edge.

23. A device according to claim 1, wherein each of said twist closures has a periphery and said grip surface is arranged to bend flexibly over said periphery when engaged with said twist closures.

24. A device according to claim 23, wherein said elastic membrane is greater in length along at least one straight line than a corresponding straight line connecting points on said inelastic edge.

25. A device according to claim 24, wherein said elastic membrane is secured to said wall of said grip part.

26. A device according to claim 1, in combination with means for torquing and closing torque on said twist closures.

27. A device for opening or closing twist closures having a grippable coupling element comprising:

a flat, elastic membrane, a grip part, and a holding part for holding said elastic membrane to said grip part, wherein said grip part has a wall and an inelastic edge circumscribing an area, said elastic membrane is secured to said inelastic edge and between said holding part and said wall, and said elastic membrane comprising a thin, soft material having a smooth grip surface arranged to contact said twist closures, which grip surface is flat in a state disengaged from said twist closures.

28. A device for opening or closing twist closures having a grippable coupling element and a flat elastic membrane, wherein said coupling element comprises a grip part and a flange-like holding part for holding said elastic membrane to said grip part, said grip part comprises a hollow body having a wall and an inelastic edge circumscribing an area, said elastic membrane is arranged to be folded over said inelastic edge and secured between said holding part and said grip part, and said elastic membrane comprising a thin, soft material having a smooth grip surface arranged to contact said twist closures, which grip surface is flat in a state disengaged from said twist closures.

29. A device for opening or closing twist closures comprising:

a grippable coupling element having a cavity and a substantially inelastic edge surrounding said cavity, and a flat, elastic membrane fastened to said inelastic edge over said cavity, wherein said coupling element comprises a plurality of parts rigidly connected to one another, said plurality of parts comprises a grip part and a holding part for holding said elastic membrane to said grip part, said cavity is formed in said grip part with a wall that extends beyond said holding part, and said inelastic edge comprises an edge on said wall having a smaller circumference than said holding part.

* * * * *